US009918496B2

(12) United States Patent
Kane et al.

(10) Patent No.: US 9,918,496 B2
(45) Date of Patent: Mar. 20, 2018

(54) ELECTRONIC SMOKING ARTICLE

(71) Applicant: Altria Client Services LLC, Richmond, VA (US)

(72) Inventors: David B. Kane, Richmond, VA (US); David R. Schiff, Highland Park, NJ (US); Tony Gatta, Philadelphia, PA (US); Chris Carrick, Newark, DE (US); Jonathan D. Albert, Philadelphia, PA (US)

(73) Assignee: Altria Client Services LLC, Richmond, VA (US)

( * ) Notice: Subject to any disclaimer, the term of this patent is extended or adjusted under 35 U.S.C. 154(b) by 870 days.

(21) Appl. No.: 14/333,999

(22) Filed: Jul. 17, 2014

(65) Prior Publication Data

US 2015/0027470 A1 Jan. 29, 2015

Related U.S. Application Data

(60) Provisional application No. 61/857,835, filed on Jul. 24, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 6,516,796 B1 * 2/2003 Cox ..... A61M 15/0003 128/200.23
2003/0230303 A1 * 12/2003 Nichols ..... A61M 11/041 128/200.14
2013/0213418 A1 * 8/2013 Tucker ..... A24F 47/008 131/328

FOREIGN PATENT DOCUMENTS

EP 2460422 A1 6/2012
EP 2460424 A1 6/2012
WO WO-2009-135729 11/2009

OTHER PUBLICATIONS

International Search Report and Written Opinion dated Feb. 11, 2015.

* cited by examiner

*Primary Examiner* — Paul S Hyun
(74) *Attorney, Agent, or Firm* — Harness, Dickey & Pierce, P.L.C.

(57) ABSTRACT

An electronic smoking article includes a reservoir containing a liquid material and having an outlet, a capillary having a capillary inlet and a capillary outlet, the capillary inlet of the capillary in communication with the outlet of the reservoir, a heater operable to heat the capillary to a temperature sufficient to at least initially volatilize liquid material contained within the capillary, and a shuttle valve between the outlet of the reservoir and the capillary inlet. The shuttle valve is operable to prevent release of liquid material from the reservoir when the shuttle valve is in a closed position and is operable to release liquid material from the reservoir when the shuttle valve is in an open position.

22 Claims, 7 Drawing Sheets

ELECTRONIC SMOKING ARTICLE

CROSS REFERENCE TO RELATED APPLICATION

This application claims priority under 35 U.S.C. § 119(e) to U.S. provisional Application No. 61/857,835, filed on Jul. 24, 2013, the entire content of which is incorporated herein by reference thereto.

WORKING ENVIRONMENT

Many of the embodiments disclosed herein include electronic smoking articles operable to deliver liquid from a liquid supply reservoir to a heater. The heater volatilizes a liquid to form an aerosol.

SUMMARY OF SELECTED FEATURES

An electronic smoking article includes a reservoir containing a liquid material and having an outlet, a capillary, a heater operable to heat the capillary to a temperature sufficient to volatilize liquid in the capillary, and a shuttle valve between the outlet of the reservoir and the capillary inlet. The shuttle valve includes a housing with a cavity, a plunger movable between a retracted position and an open position, and at least two spaced apart seals. The shuttle valve is operable to prevent release of liquid material from the reservoir when the shuttle valve is in a retracted position and to release liquid material from the reservoir to the capillary inlet when the shuttle valve is in an open position.

A method of delivering liquid to an aerosolizer of an electronic smoking article comprises controlling flow to an aerosolizer with a valve. The controlling step includes establishing communication of a reservoir with the aerosolizer while operating the aerosolizer and closing the communication. The closing includes communicating the aerosolizer with a flow-back cavity separate of the reservoir. At least some residual liquid is drawn back from the aerosolizer upon the closing.

DETAILED DESCRIPTION

An electronic smoking article such as an electronic smoking article includes a manually operated shuttle valve operable to control flow of a liquid material from a pressurized liquid supply (reservoir) to a capillary, prevent leaks, and avoid excessive drawback of liquid from the capillary and introduction of air bubbles to the reservoir. As used herein, the term "electronic smoking article" is inclusive of all types of electronic smoking articles, regardless of form, size or shape, including electronic cigarettes, electronic cigars, electronic pipes, electronic hookahs and the like. The liquid aerosol formulation can include nicotine or be nicotine free. Moreover, the liquid aerosol formulation can include tobacco flavors or instead, or in combination include other suitable flavors.

Optionally, the electronic smoking article such as an electronic smoking article can also include a sheath flow and aerosol promoter (SFAP) insert operable to produce and deliver a more fully developed aerosol. Once an aerosol is generated, the aerosol flows into the SFAP insert and is cooled by air which enters the electronic smoking article downstream of a heater. Because the air enters downstream of the heater and upstream of the SFAP insert, the aerosol is quickly cooled to produce smaller particles. The SFAP insert includes a constriction which can enhance cooling of the aerosol by reducing the cross-section of the aerosol flow so as to increase the rate of heat transfer from the center of the aerosol flow to walls of the SFAP insert. The increased cooling rate increases the rate of particle formation resulting in smaller particle sizes. Channels provided on an exterior of the SFAP allow aerosol-free (sheath) air to be drawn into a mixing chamber downstream of the constriction where the sheath air produces a boundary layer that is operable to minimize condensation of the aerosol on walls of the SFAP insert so as to increase the delivery rate (efficiency) of the aerosol.

Figure 1:
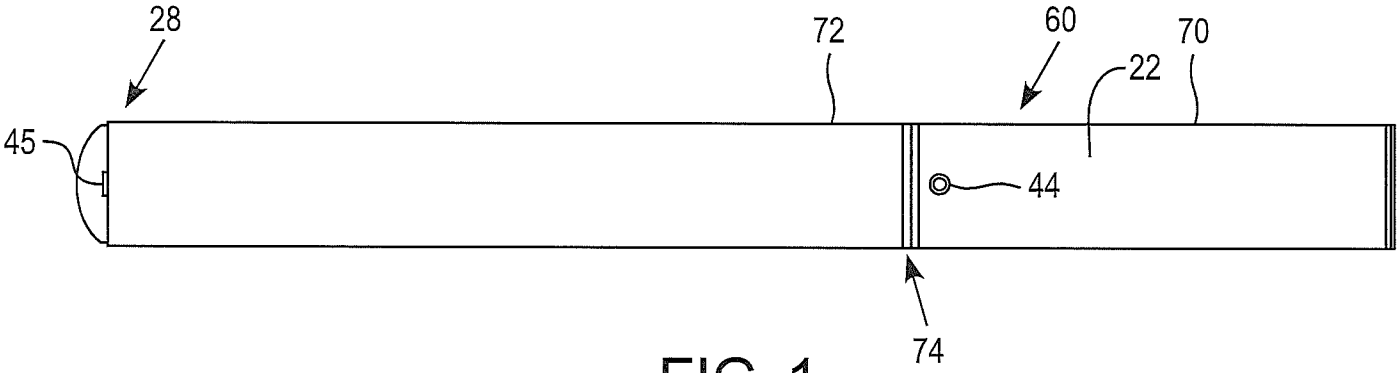
FIG. 1 is a side view of an electronic smoking article.
Figure 2:
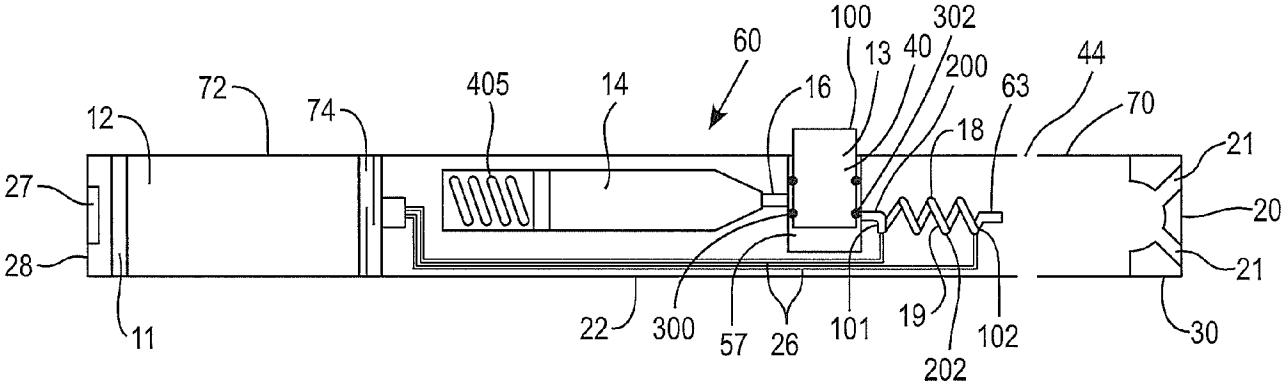
FIG. 2 is a side view of an electronic smoking article including a shuttle valve.

As shown in FIGS. 1 and 2, an electronic smoking article 60 comprises a replaceable cartridge (or first section) 70 and a reusable fixture (or second section) 72, which are coupled together at a threaded joint 74 or by other convenience such as a snug-fit, snap-fit, detent, clamp and/or clasp.

As shown in FIG. 2, the first section 70 can house a mouth end insert 20, optionally a SFAP insert 220 (shown in FIGS. 7 and 8), a capillary aerosol generator including a capillary 18, a heater 19 to heat at least a portion of the capillary (or capillary tube) 18, a reservoir 14, and a shuttle valve 40. The second section 72 can house a power supply 12 and control circuitry 11. The threaded portion 74 of the second section 72 can be connected to a battery charger when not connected to the first section 70 for use so as to charge the battery.

Figure 3:
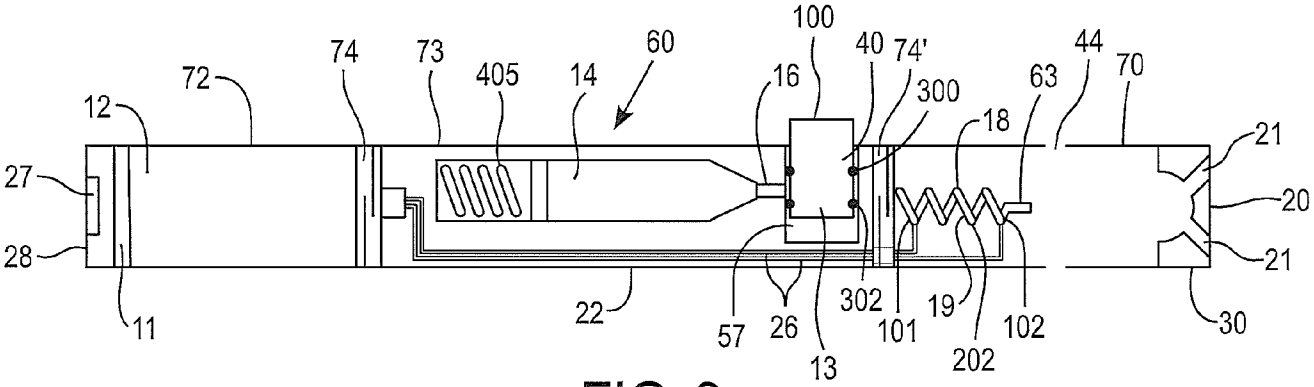
FIG. 3 is a side view of a second embodiment of an electronic smoking article including a shuttle valve.
Figure 4:
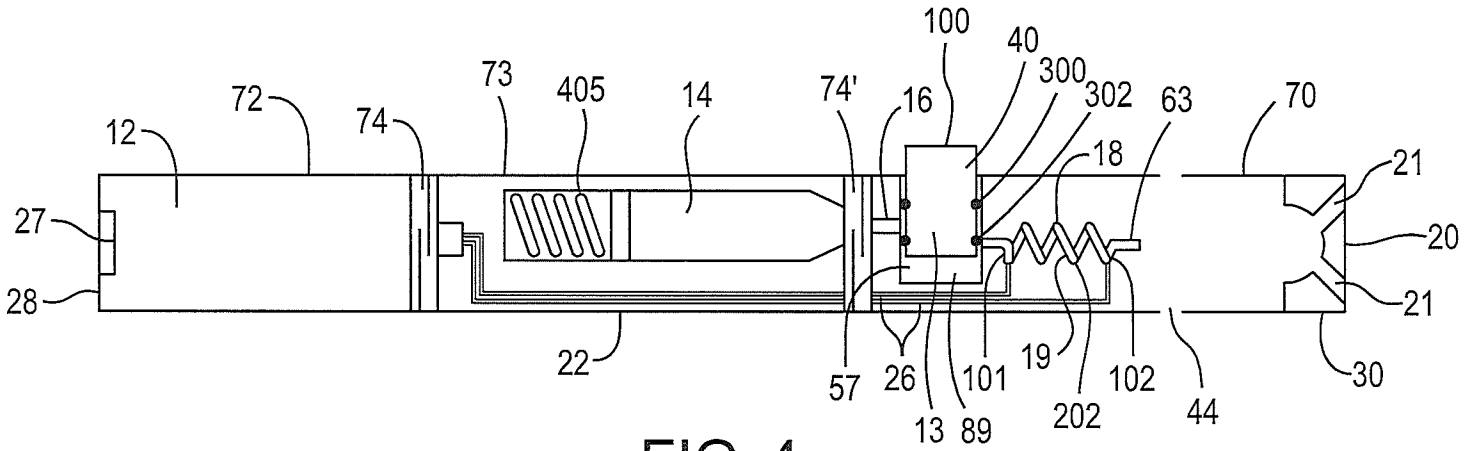
FIG. 4 is a side view of a third embodiment of an electronic smoking article including a shuttle valve.

As shown in FIGS. 3 and 4, the electronic smoking article 60 can also include a middle section (third section) 73. The middle section 73, shown in FIG. 3, can house the reservoir 14 and the valve 40, while the first section 70 can house a capillary aerosol generator including a capillary 18, a heater 19 to heat at least a portion of the capillary 18 and a mouth end insert 20. As shown in FIG. 4, the middle section 73 can house the reservoir 14 and the first section 70 can house the valve 40 and a capillary aerosol generator including a capillary 18, a heater 19, and a mouth end insert 20.

The middle section 73 of FIGS. 3 and 4 can be adapted to be fitted with a threaded joint 74' at an upstream end of the first section 70 and a threaded joint 74 at a downstream end of the second section 72.

Preferably, the first section 70, the second section 72 and the optional third section 73 include an outer cylindrical housing (casing) 22 extending in a longitudinal direction along the length of the electronic smoking article 60. Moreover, in one embodiment, the middle section 73 is disposable and the first section 70 and/or second section 72 are reusable. In another embodiment, the first section 70 is also disposable so as to avoid the need for cleaning the capillary 18 and/or heater 19. The sections 70, 72, 73 can be attached by threaded connections whereby the middle section 73 can be replaced when the reservoir 14 is used up.

In another embodiment, the housing 22 may comprise a single, unitary tube, without any threaded connections.

In the preferred embodiment, as shown in FIGS. 2-8, the reservoir 14 is a pressurized reservoir. For example, the reservoir 14 can be pressurized using a pressurization arrangement 405 (shown in FIGS. 2-4 and 7-8) which applies constant pressure to the reservoir 14. For example, the pressurization arrangement 405 can include an internal or external spring and plate (or piston) arrangement which constantly applies pressure to the reservoir 14. Alternatively, the reservoir 14 can be compressible and positioned between a pressurization arrangement 405 including two plates that are connected by springs or the reservoir 14 could be compressible and positioned between the outer casing and a plate that are connected by a spring so that the plate applies pressure to the reservoir 14.

Preferably, the pressurized reservoir 14 has an outlet 16 which in effect, is an inlet 16 to the shuttle valve 40 that controls fluid communication with the capillary 18. The shuttle valve 40 is positioned between the outlet 16 of the reservoir 14 and an outlet passage 105, which in turn communicates with the capillary 18 so as to control delivery of liquid material from the reservoir 14.

Preferably, the pressurized reservoir 14 extends longitudinally within the outer cylindrical casing 22 of the first section 70 (shown in FIG. 2) or the middle section 73 (shown in FIGS. 3 and 4). The pressurized reservoir 14 comprises a liquid material which is volatilized when heated and forms an aerosol when discharged from the capillary 18.

Preferably, the liquid material includes a tobacco-containing material including volatile tobacco flavor compounds which are released from the liquid upon heating. The liquid may also be a tobacco flavor containing material and/or a nicotine-containing material. Alternatively, or in addition, the liquid may include a non-tobacco material and/or may be nicotine-free. For example, the liquid may include water, solvents, ethanol, plant extracts and natural or artificial flavors. Preferably, the liquid further includes an aerosol former. Examples of suitable aerosol formers are glycerine and propylene glycol.

Figure 5:
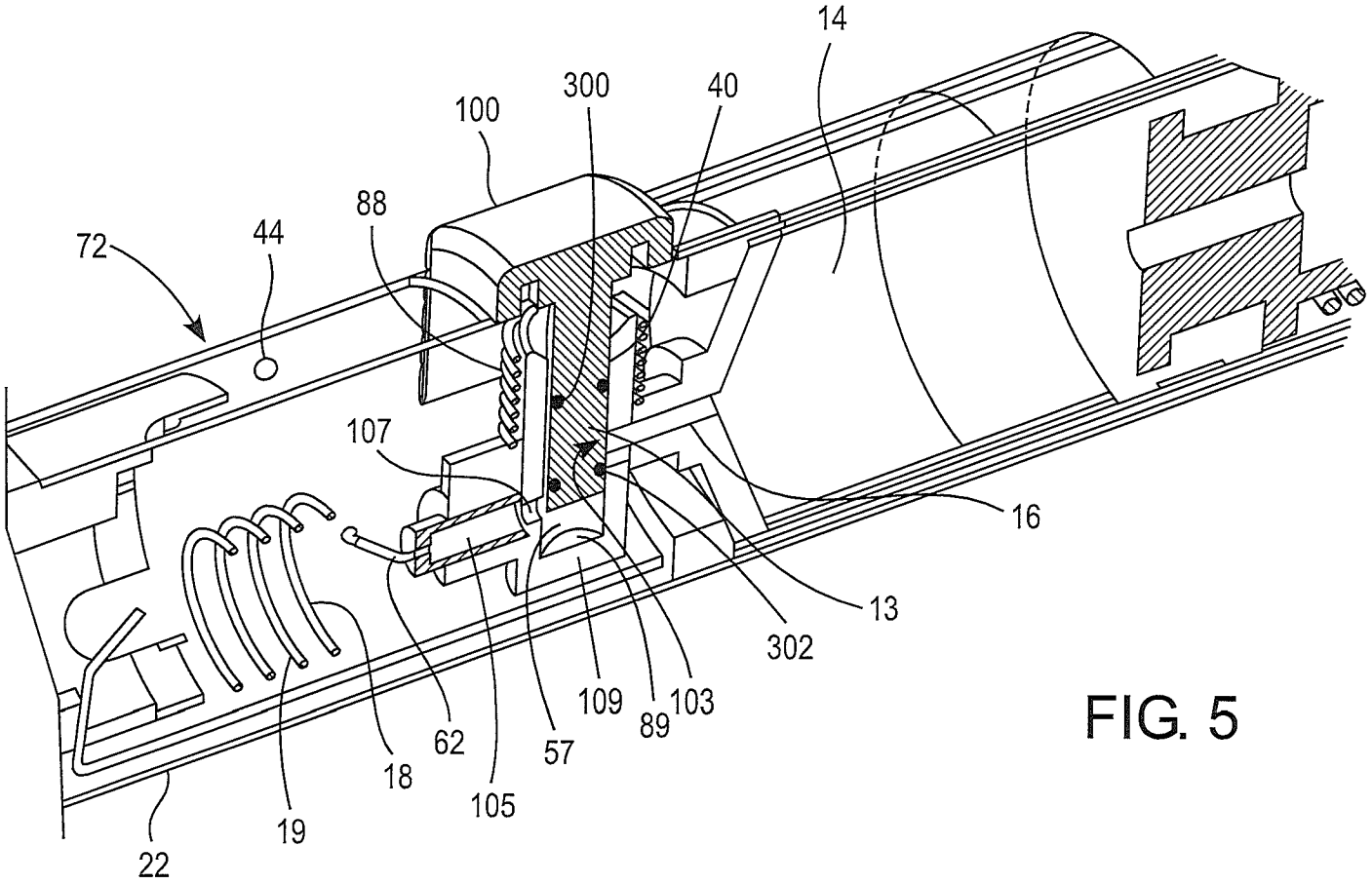
FIG. 5 is a perspective view of a shuttle valve in a closed position.
Figure 6:
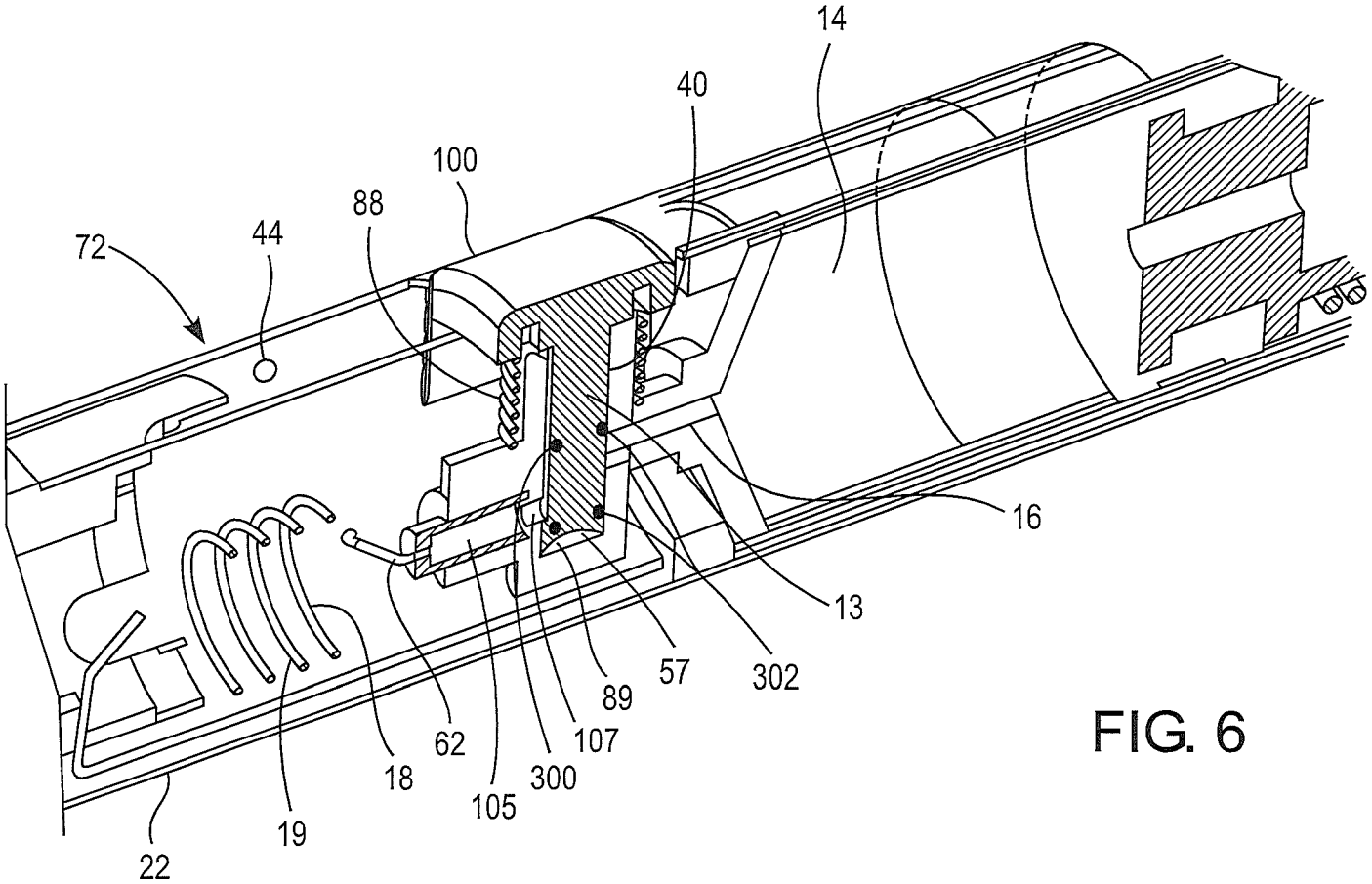
FIG. 6 is a perspective view of the shuttle valve of FIG. 4 in an open position.

Referring now to FIG. 5, in an embodiment, the shuttle valve 40 includes a plunger 13 integrally formed with a "push-button" actuator 100. The plunger 13 is movable along a cavity 57 of a valve housing 101 from a first, retracted position which is shown in FIG. 5, and a second open position as shown in FIG. 6. The plunger 13 includes a pair of spaced-apart seals (o-rings) 300, 302, which sealingly slide along the walls of the valve housing 101 which define the cavity 57. The plunger 13 and the cavity 57 extend transversely to the longitudinal axis of the electronic smoking article 60. The outlet 16 of the reservoir is in fluid communication with the cavity 57 at a first location 103 and the outlet passage 105 of the valve 40 with cavity 57 at a second location 107, which is spaced from the first location 103. The spacing between the first location 103 and the second location 107 and the spacing between the first and second seals 300, 302 are such that, when the plunger 13 is in its retracted position, the inlet passage 16 of the valve 40 is disposed between seals 300, 302, and the outlet passage 105 of the valve 40 is disposed below (on the other side) of the second, lower seal 302. Accordingly, the inlet passage 16 is closed and out of communication with the outlet passage 105 of the valve 40.

Still referring to FIG. 5, when the plunger 13 is in its retracted position, the lowest-most portion of the plunger 13 is spaced from a lowest-most portion of the cavity 57 adjacent a bottom portion 109 of the valve housing 101 so as to define a draw-back cavity 89. The outlet passage 105 is at least partially disposed below the lowest-most portion of the retracted plunger 13 such that communication is established between the outlet passage 105 and the draw-back cavity 89 as the plunger 13 returns to its retracted position as shown in FIG. 5. Thereupon, liquid that may have remained in the valve outlet passage 105 and/or in portions of the capillary 18 upon conclusion of an operation of the device is drawn back into the draw-back cavity 89. The draw-back of residual liquid avoids sputtering and other inconsistencies when the capillary 18 undergoes its next operation (aerosolization). It also avoids air being drawn back into the reservoir 14, which might otherwise frustrate precise operation of the liquid-feed.

The plunger 13 is sized such that the cavity 57 is slightly bigger than the diameter and/or dimensions of the plunger 13 such that liquid can flow in the space between the plunger 13 and the walls of the cavity 57.

When the shuttle valve 40 is closed, the actuator 100 extends through the outer casing 22 of the electronic smoking article 60. A spring 88 biases the plunger 13 toward its retracted position and provides resistance when pressing the actuator 100. When the spring 88 is at rest, the shuttle valve 40 remains closed.

In one embodiment, a bottom portion 109 of the valve housing 101 adjacent the draw-back cavity 89 portion of the cavity 57 can be formed of, or provided with, a deformable material, such as rubber. Use of such a deformable material may aid in relieving pressure within the bottom portion 109 as the shuttle valve 40 is activated (or opened).

Preferably, the first seal 300 and a second seal 302 are O-rings, each of which encircles a periphery of the plunger 13 along the length thereof. Also preferably, the first seal 300 and the second seal 302 are arranged such that when the shuttle valve 40 is in the open position, as shown in FIG. 6, both the inlet 16 and the outlet 105 of the valve 40 are positioned between the location of the first seal 300 and the second seal 302 along the plunger 13, such that liquid may flow from the reservoir, through the valve 40 and into the capillary 18.

When the shuttle valve 40 is in the closed position, as shown in FIG. 5, the first seal 300 and the second seal 302 are positioned so that only the valve inlet 16 is between the first seal 300 and the second seal 302. The liquid from the reservoir is trapped in the annular space around the periphery of the plunger 13 between the first seal 300 and the second seal 302. Liquid is blocked from flowing into the outlet 105 of the valve when the shuttle valve 40 is in the closed position. In addition, when the shuttle valve 40 is in the closed position, the plunger 13 does not extend to the bottom 109 of the valve housing 101 so as to define the draw-back cavity 89 below the plunger 13. Preferably, the outlet passage 105 of the valve 40 is in fluid communication with the draw-back cavity 89 so that a minute amount of liquid remaining in the inlet end 62 of the capillary 18 can flow back into the draw-back cavity 89.

Referring now to FIG. 6, in use, a smoker (vaporer) presses the actuator 100 to open the shuttle valve 40 to release liquid from the reservoir via the valve inlet 16 and the outlet passage 105 to the inlet end 62 of the capillary 18.

Once the actuator 100 is pressed, the control circuitry 11 communicates with the power supply 12 to activate the heater 19 so that the heater 19 is heated for so long as liquid is being released from the reservoir 14 to volatilize the liquid. Upon discharge from the heated capillary 18, the volatilized material expands, mixes with air and forms an aerosol. The control circuitry further includes a heater activation light 27 at an upstream end of the electronic smoking article 60. The heater activation light 27 is operable to light up when the heater 19 is activated.

Once the actuator 100 is released, the shuttle valve 40 closes and liquid can no longer flow from the reservoir 14 to the capillary 18. Advantageously, the smoker can tailor the smoking (vaping) experience by pressing the actuator 100 for a longer period of time to produce a larger amount of aerosol or for a shorter period of time to produce a smaller amount of aerosol.

In the preferred embodiment, when the shuttle valve 40 is opened, the inlet end 62 of the capillary 18 is in fluid communication with the outlet 16 of the reservoir 14, and an outlet end 63 of the capillary (shown in FIGS. 2, 3, 4, 7 and 8) is operable to expel volatilized liquid material from the capillary 18.

Preferably, the capillary 18 has an internal diameter of 0.01 to 10 mm, preferably 0.05 to 1 mm, and more preferably 0.05 to 0.4 mm. For example, the capillary can have an internal diameter of about 0.05 mm. Capillaries of smaller internal diameter provide more efficient heat transfer to the fluid because, with the shorter distance to the center of the fluid, less energy and time is required to vaporize the liquid.

Also preferably, the capillary 18 may have a length of about 5 mm to about 72 mm, more preferably about 10 mm to about 60 mm or about 20 mm to about 50 mm. For example, the capillary 18 can be about 50 mm in length and arranged such that a downstream, about 40 mm long, coiled portion of the capillary 18 forms a heated section 202 and an upstream, about 10 mm long, portion of the capillary 18 remains relatively unheated when the heater 19 is activated (shown in FIG. 2).

In one embodiment, the capillary 18 is substantially straight. In other embodiments, the capillary 18 is coiled and/or includes one or more bends therein to conserve space.

In the preferred embodiment, the capillary 18 is formed of a conductive material, and thus acts as its own heater 19 by passing current through the capillary. The capillary 18 may be any electrically conductive material capable of being resistively heated, while retaining the necessary structural integrity at the operating temperatures experienced by the capillary 18, and which is non-reactive with the liquid material. Suitable materials for forming the capillary 18 are selected from the group consisting of stainless steel, copper, copper alloys, porous ceramic materials coated with film resistive material, Inconel® available from Special Metals Corporation, which is a nickel-chromium alloy, nichrome, which is also a nickel-chromium alloy, and combinations thereof.

In one embodiment, the capillary 18 is a stainless steel capillary 18, which serves as a heater 19 via electrical leads 26 attached thereto for passage of direct or alternating current along a length of the capillary 18. Thus, the stainless steel capillary 18 is heated by resistance heating. The stainless steel capillary 18 is preferably circular in cross section. The capillary 18 may be of tubing suitable for use as a hypodermic needle of various gauges. For example, the capillary 18 may comprise a 32 gauge needle having an internal diameter of 0.11 mm or a 26 gauge needle having an internal diameter of 0.26 mm.

In another embodiment, the capillary 18 may be a non-metallic tube such as, for example, a glass tube. In such an embodiment, the heater 19 is formed of a conductive material capable of being resistively heated, such as, for example, stainless steel, nichrome or platinum wire, arranged along the glass tube. When the heater arranged along the glass tube is heated, liquid material in the capillary 18 is heated to a temperature sufficient to at least partially volatilize liquid material in the capillary 18.

Preferably, at least two electrical leads 26 are bonded to a metallic capillary 18. In the preferred embodiment, the electrical leads 26 are brazed to the capillary 18. Preferably, one electrical lead 26 is brazed to a first, upstream portion 104 of the capillary 18 and a second electrical lead 26 is brazed to a downstream, end portion 102 of the capillary 18, as shown in FIG. 2.

In use, once the capillary 18 is heated, the liquid material contained within a heated portion of the capillary 18 is volatilized and ejected out of the outlet 63 (shown in FIGS. 2, 7 and 8) where it expands and mixes with air and forms an aerosol in a mixing chamber 46. The mixing chamber 46 can be positioned upstream of a sheath flow and aerosol promoter (SFAP) insert 220, as shown in FIG. 7, or in the SFAP insert 220 as shown in FIG. 8.

Preferably, the electronic smoking article 60 also includes at least one air inlet 44 operable to deliver at least some air to the mixing chamber 46 and to a growth cavity 240, downstream of the mixing chamber 46. Preferably, air inlets 44 are arranged downstream of the capillary 18 so as to minimize drawing air along the capillary and thereby avoid cooling of the capillary 18 during heating cycles.

Figure 7:
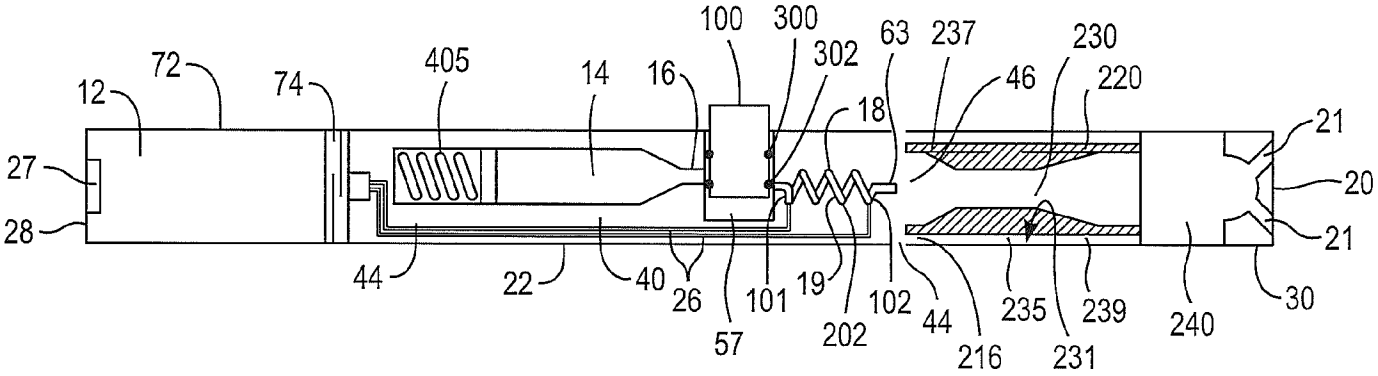
FIG. 7 is a side view of another embodiment of an electronic smoking article including a shuttle valve and a sheath flow and aerosol promoter (SFAP) insert.
Figure 8:
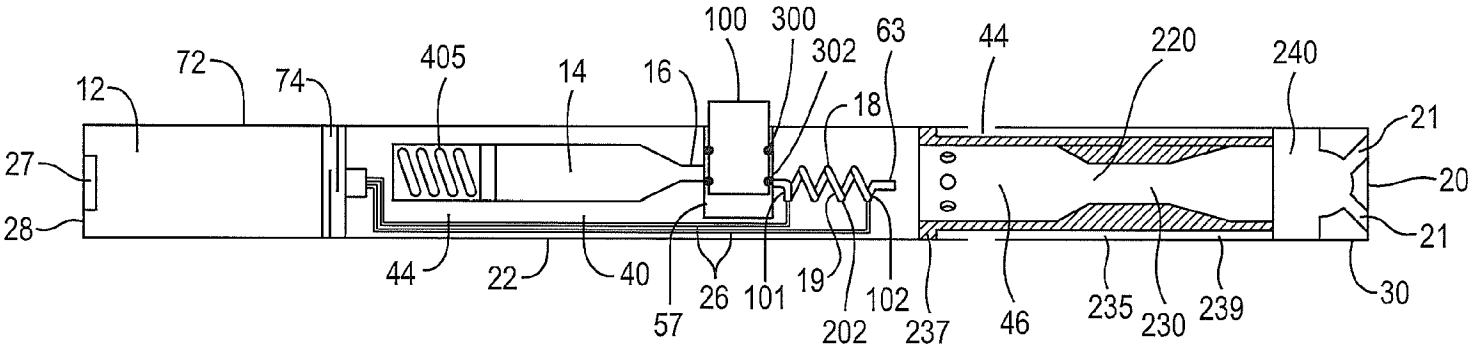
FIG. 8 is a side view of another embodiment of an electronic smoking article including a shuttle valve and a sheath flow and aerosol promoter (SFAP) insert.
Figure 9:
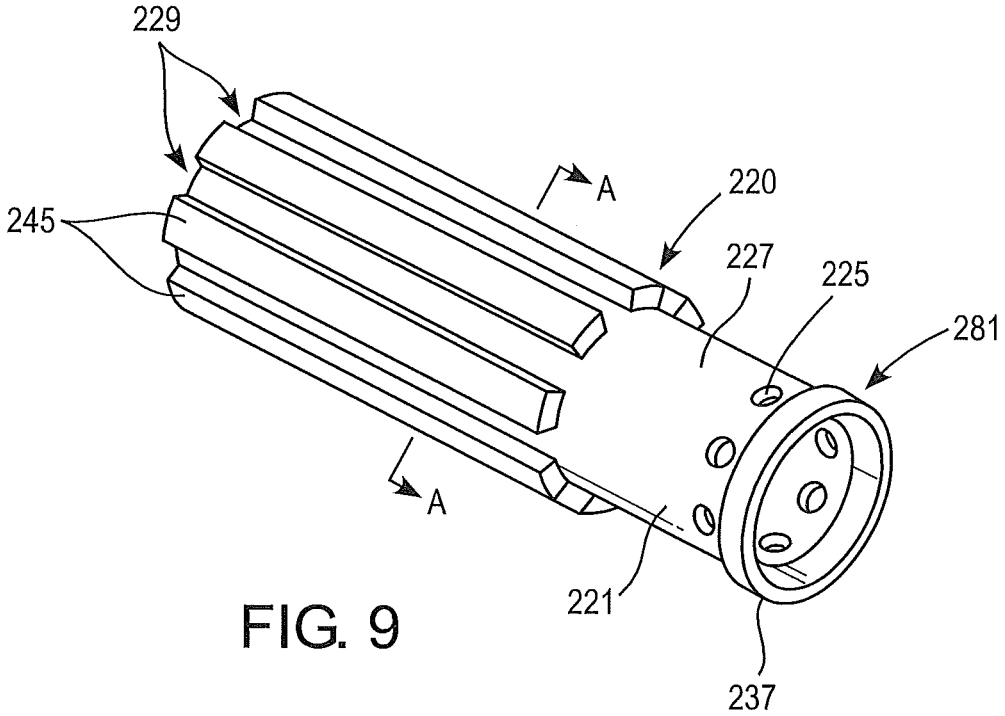
FIG. 9 is a perspective view of a sheath flow and aerosol promoter (SFAP) insert for use in an electronic smoking article.

In one embodiment, the air inlets 44 can be upstream of a downstream end 281 of the SFAP insert 220, as shown in FIGS. 7-9. In other embodiments, the air inlets 44 can be superposed with the SFAP insert 220. Optionally, air holes 225 in a wall 227 of the SFAP insert 220 (shown in FIG. 9), can allow some air to enter the mixing chamber 46 of the SFAP insert 220. In addition to the air holes 225, as shown in FIG. 9, the SFAP insert 220 can include a lip portion 237 (shown in FIG. 8) at an upstream end thereof, which prevents passage of air. Alternatively, the lip portion 237 can be arranged such that air can travel through a gap 216 (shown in FIG. 7) between the lip 237 of the SFAP insert 220 and an inner surface 231 of the outer casing 22 prior to entering the mixing chamber 46 within the SFAP insert 220.

Figure 10:
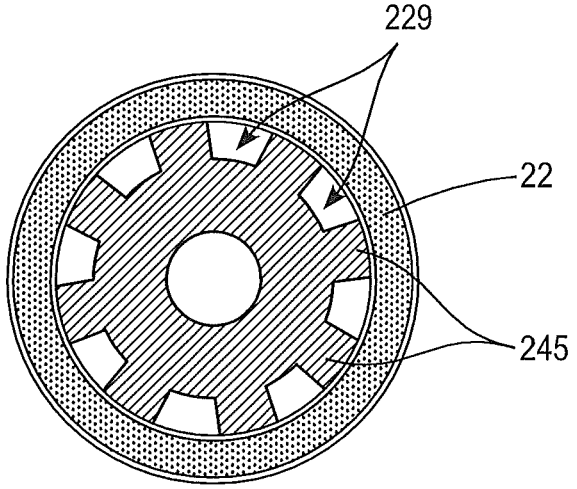
FIG. 10 is a cross-sectional view of the SFAP insert along line A-A of FIG. 9.

Air that enters via the air inlets 44 ("sheath air") can flow along an external surface of the SFAP insert 220 via channels 229 extending longitudinally along the external surface of the SFAP insert 220 between vanes 245 as shown in FIGS. 9 and 10. The vanes 245 extend longitudinally along an outer surface 221 of the SFAP insert 220 and in spaced apart relation so as to form the channels 229 therebetween. Once the aerosol passes through a constriction 230 in the SFAP insert 220, as shown in FIGS. 7 and 8, the aerosol enters the downstream growth cavity 240 where the aerosol can mix with sheath air and the sheath air can act as a barrier between an inner surface of the growth cavity 240 and the aerosol so as to minimize condensation of the aerosol on walls of the growth cavity 240.

In the embodiment shown in FIG. 7, in which the SFAP insert 220 includes the lip portion 237 spaced from the inner surface 231 of the outer casing 22, and air that enters the air inlets 44 is split into two air streams. The first air stream travels through the channels 229 on the outside of the insert 220. The remaining air flows upstream through the gap 235, around the lip portion 237, which in this embodiment does not extend to the inner surface of the outer casing 22, and through the constriction 230 along with the volatilized liquid material. While not wishing to be bound by theory, it is believed that about 5% to about 20% of the air passing through the constriction 230 is sheath air.

In the preferred embodiment, the at least one air inlet 44 includes one or two air inlets. Alternatively, there may be three, four, five or more air inlets. Altering the size and number of air inlets 44 can also aid in establishing the resistance to draw of the electronic smoking article 60. Preferably, the air inlets 44 communicate with the channels 229 arranged between the SFAP insert 220 and the inner surface 231 of the outer casing 22.

In the preferred embodiment, the SFAP insert 220 is operable to provide an aerosol that is similar to cigarette smoke, has a mass median particle diameter of less than 1 micron and aerosol delivery rates of at least about 0.01 $mg/cm^3$. Once the aerosol is formed at the heater, the aerosol passes to the mixing chamber 46 where the aerosol mixes with sheath air and is cooled. The sheath air causes the aerosol to supersaturate and nucleate to form new particles. The faster the aerosol is cooled the smaller the final diameter of the aerosol particles. When air is limited, the aerosol will not cool as fast and the particles will be larger. Moreover, the aerosol may condense on surfaces of the electronic smoking article resulting in lower delivery rates. The SFAP insert 220 prevents or at least abates the tendency of the aerosol to condense on surfaces of the electronic smoking article and quickly cools the aerosol so as to produce a small particle size and high delivery rates as compared to electronic smoking articles not including the SFAP insert as described herein.

Accordingly, the SFAP insert 220 can include a mixing chamber 46 adjacent to an upstream end of the SFAP insert 220 (as shown in FIG. 7) or inside the SFAP insert 220 (as shown in FIG. 8). The mixing chamber 46 leads to the constriction 230 having a reduced diameter as compared to the mixing chamber 46. Preferably, the diameter of the constriction 230 is about 0.125 inch to about 0.1875 inch and is about 0.25 inch to about 0.5 inch long. The constriction 230 leads to the growth cavity 240 which is preferably about 2 inches in length and has a diameter of about 0.3125 inch. Preferably, the SFAP insert 220 is spaced about 0.2 to about 0.4 inch from the outlet 63 of the capillary 18. Moreover, the channels 229 formed on the outer surface 221 of the SFAP insert 220 form about 10% of the total cross-sectional area of the SFAP insert 220 and allow sheath air to pass between the outer surface 221 of the SFAP insert 220 and the inner surface 231 of the outer cylindrical casing 22.

In the embodiments described herein, the valve 40 and its plunger 13 operate in a transverse orientation. Alternatively, the valve 40 may be oriented in a longitudinal orientation. In either orientation, a servo or cam or other suitable arrangement may be used instead or in combination with the "push-button" actuator 100. In addition, the valve 40 is adaptable to operation in electronic smoking articles which include a heater coil and wick to volatilize (aerosolize) liquid, such that the valve 40 delivers liquid to the heater coil and wick.

In the preferred embodiment, the power supply 12 includes a battery arranged in the electronic smoking article 60. The power supply 12 is operable to apply voltage across the heater 19 associated with the capillary 18. Thus, the heater 19 is heated to a temperature sufficient to volatilize liquid material according to a power cycle of either a predetermined time period, such as a 2 to 10 second period, or for so long as pressure is applied to the actuator 100 which opens the shuttle valve 40.

Preferably, the electrical contacts or connection between the heater 19 and the electrical leads 26 are highly conductive and temperature resistant while the heater 19 is highly resistive so that heat generation occurs primarily along the heater 19 and not at the contacts.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker until the energy in the power supply is depleted. Alternatively, the power supply 12 may be rechargeable and include circuitry allowing the battery to be chargeable by an external charging device. In that case, preferably the circuitry, when charged, provides power for a pre-determined number of puffs, after which the circuitry must be re-connected to an external charging device.

In the preferred embodiment, the reservoir 14 includes a liquid material which has a boiling point suitable for use in the electronic smoking article 60. If the boiling point is too high, the heater 19 will not be able to vaporize liquid in the capillary 18. However, if the boiling point is too low, the liquid may vaporize without the heater 19 being activated.

In use, liquid material is transferred from the reservoir 14 to the heated capillary 18 by manually operating the shuttle valve 40.

As shown in FIGS. 2, 3, 7 and 8 the electronic smoking article 60 further includes a mouth end insert 20 having at least two off-axis, preferably diverging outlets 21. Preferably, the mouth end insert 20 is in fluid communication with the mixing chamber 46 and includes at least two diverging outlets 21. (e.g. 3, 4, 5, or preferably 6 to 8 outlets or more). Preferably, the outlets 21 of the mouth end insert 20 are located at ends of off-axis passages and are angled outwardly in relation to the longitudinal direction of the electronic smoking article 60 (i.e., divergently). As used herein, the term "off-axis" denotes at an angle to the longitudinal direction of the electronic smoking article. Also preferably, the mouth end insert (or flow guide) 20 includes outlets uniformly distributed around the mouth end insert 20 so as to substantially uniformly distribute aerosol in a smoker's mouth during use. Thus, as the aerosol passes into a smoker's mouth, the aerosol enters the mouth and moves in different directions so as to provide a full mouth feel as compared to electronic smoking articles having an on-axis single orifice which directs the aerosol to a single location in a smoker's mouth.

In addition, the outlets 21 and off-axis passages are arranged such that droplets of unaerosolized liquid material carried in the aerosol impact interior surfaces of the mouth end insert 20 and/or interior surfaces of the off-axis passages such that the droplets are removed or broken apart. In the preferred embodiment, the outlets 21 of the mouth end insert 20 are located at the ends of the off-axis passages and are angled at about 5° to about 60° with respect to the central longitudinal axis of the electronic smoking article 60 so as to more completely distribute aerosol throughout a mouth of a smoker during use and to remove droplets.

Preferably, each outlet 21 has a diameter of about 0.015 inch to about 0.090 inch (e.g., about 0.020 inch to about 0.040 inch or about 0.028 inch to about 0.038 inch). The size of the outlets 21 and off-axis passages along with the number of outlets 21 can be selected to adjust the resistance to draw (RTD) of the electronic smoking article 60, if desired.

In a preferred embodiment, the electronic smoking article 60 is about the same size as a conventional smoking article.

In some embodiments, the electronic smoking article 60 can be about 80 mm to about 110 mm long, preferably about 80 mm to about 100 mm long and about 7 mm to about 8 mm in diameter. For example, in an embodiment, the electronic smoking article is about 84 mm long and has a diameter of about 7.8 mm.

The outer cylindrical casing 22 of the electronic smoking article 60 may be formed of any suitable material or combination of materials. Preferably, the outer cylindrical casing 22 is formed of metal and is part of the electrical circuit. Examples of other suitable materials include metals, alloys, plastics or composite materials containing one or more of those materials, or thermoplastics that are suitable for food or pharmaceutical applications, for example polypropylene, polyetheretherketone (PEEK), ceramic, low density polyethylene (LDPE) and high density polyethylene (HDPE). Preferably, the material is light and non-brittle. The outer cylindrical casing 22 can be any suitable color and/or can include graphics or other indicia printed thereon.

In an embodiment, the volatilized material formed as described herein can at least partially condense to form an aerosol including particles. Preferably, the particles contained in the vapor and/or aerosol range in size from about 0.5 micron to about 1 micron or about 1 micron to about 4 microns. In the preferred embodiment, the vapor and/or aerosol has particles of about 3.3 microns or less, more preferably about 2 microns or less. Also preferably, the particles are substantially uniform throughout the vapor and/or aerosol.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. An electronic smoking article comprising:

a reservoir containing a liquid material and having an outlet;

a capillary configured to receive the liquid material from the reservoir;

a heater operable to heat the capillary to a temperature sufficient to volatilize the liquid material received in the capillary; and a shuttle valve between the outlet of the reservoir and a capillary inlet, the shuttle valve comprising a housing with a cavity; a plunger movable between a retracted position and an open position; and at least two spaced apart seals, the shuttle valve being operable to prevent release of the liquid material from the reservoir when the shuttle valve is in a retracted position and to release the liquid material from the reservoir to the capillary inlet when the shuttle valve is in an open position, the plunger sized and configured to fit within the cavity such that the liquid material can flow in a space between a wall of the plunger and a wall of the cavity and the at least two spaced apart seals are operable to prevent flow of the liquid material to the capillary inlet when the shuttle valve is in the retracted position.

2. The electronic smoking article of claim 1, wherein the plunger and the housing establish a draw-back chamber when the plunger is in the retracted position, and an outlet of the shuttle valve communicates the capillary with the draw-back chamber when the plunger returns to the retracted position from the open position.

3. The electronic smoking article of claim 1, wherein the capillary has an internal diameter of about 0.05 to 0.4 mm and a length of about 5 mm to about 72 mm.

4. The electronic smoking article of claim 1, wherein the capillary comprises a stainless steel tube.

5. The electronic smoking article of claim 1, further including an actuator integrally formed with the plunger, the actuator operable to move the plunger between the retracted position and the open position.

6. The electronic smoking article of claim 5, further including an electrical switch operable to actuate the heater when the shuttle valve is in the open position.

7. The electronic smoking article of claim 5, wherein the actuator extends through an opening in an outer casing of the electronic smoking article.

8. The electronic smoking article of claim 1, wherein the cavity has a bottom portion formed of a deformable material.

9. The electronic smoking article of claim 1, wherein the capillary has an internal diameter of about 0.05 to 0.4 mm and a length of about 10 mm to 60 mm.

10. An electronic smoking article comprising:

a reservoir containing a liquid material and having an outlet;

a capillary configured to receive the liquid material from the reservoir;

a heater operable to heat the capillary to a temperature sufficient to volatilize the liquid material received in the capillary;

a shuttle valve between the outlet of the reservoir and a capillary inlet, the shuttle valve comprising a housing with a cavity; a plunger movable between a retracted position and an open position; and at least two spaced apart seals, the shuttle valve being operable to prevent release of the liquid material from the reservoir when the shuttle valve is in a retracted position and to release the liquid material from the reservoir to the capillary inlet when the shuttle valve is in an open position; and a sheath flow and aerosol promoter (SFAP) insert downstream of the capillary, the SFAP insert including an aerosol passage and a constriction and extending longitudinally between a mixing chamber and an aerosol formation chamber;

wherein the plunger and the housing establish a draw-back chamber when the plunger is in the retracted position, and an outlet of the shuttle valve communicates the capillary with the draw-back chamber when the plunger returns to the retracted position from the open position.

11. The electronic smoking article of claim 10, wherein the electronic smoking article includes at least one air inlet in an outer casing, the at least one air inlet being superimposed with the SFAP insert, the mixing chamber is within an upstream portion of the SFAP insert and the SFAP insert includes a plurality of air holes in an upstream end thereof, the plurality of air holes operable to allow air to flow therethrough to the mixing chamber.

12. The electronic smoking article of claim 11, wherein about 80% to about 95% of ambient air entering the at least one air inlet flows into the mixing chamber and about 5% to about 20% of the ambient air is sheath air that flows through longitudinally extending channels formed between longitudinally extending vanes on an outer surface of the SFAP insert and an inner surface of the outer casing of the electronic smoking article.

13. The electronic smoking article of claim 12, wherein the sheath air flows into a growth cavity downstream of the SFAP insert, and the SFAP insert is operable to substantially prevent deposition of an aerosol on the inner surface of the outer casing so as to promote an increase in delivery rate of the aerosol.

14. The electronic smoking article of claim 10, further comprising:

a power supply operable to apply voltage across the heater;

the mixing chamber downstream of the capillary; and at least one air inlet operable to deliver ambient air into the mixing chamber, the ambient air being mixed with volatilized liquid material exiting the capillary into the mixing chamber to form an aerosol.

15. The electronic smoking article of claim 14, wherein the power supply includes a battery.

16. The electronic smoking article of claim 15, wherein the heater comprises a section of the capillary connected to the battery by two spaced apart electrical leads.

17. The electronic smoking article of claim 14, further including control circuitry operable to control supply of power from the power supply to the heater.

18. The electronic smoking article of claim 17, wherein the control circuitry further includes a heater activation light at an upstream end of the electronic smoking article, the heater activation light operable to light up when the heater is activated.

19. The electronic smoking article of claim 17, wherein the electronic smoking article includes a first section, a second section, and a third section, and wherein the first section contains the capillary, the second section contains the power supply and the control circuitry, and the third section contains the reservoir.

20. The electronic smoking article of claim 19, wherein the first section is reusable and the second section is replaceable.

21. The electronic smoking article of claim 10, wherein the electronic smoking article includes at least one air inlet upstream of the SFAP insert, and the mixing chamber is upstream of the SFAP insert such that air flows through the at least one air inlet and into the mixing chamber.

22. A method of delivering liquid to an aerosolizer of an electronic smoking article, comprising:

controlling flow to an aerosolizer with a valve, said controlling flow including:

establishing communication of a reservoir with said aerosolizer while operating said aerosolizer; and closing said communication, said closing including communicating said aerosolizer with a flow-back cavity separate of said reservoir, whereby at least some residual liquid is drawn back from said aerosolizer upon said closing.

* * * * *